US010568415B1

(12) United States Patent
Kuyath

(10) Patent No.: US 10,568,415 B1
(45) Date of Patent: Feb. 25, 2020

(54) PORTABLE TABLE

(71) Applicant: Neil Alan Kuyath, Batavia, OH (US)

(72) Inventor: Neil Alan Kuyath, Batavia, OH (US)

( * ) Notice: Subject to any disclaimer, the term of this patent is extended or adjusted under 35 U.S.C. 154(b) by 0 days.

(21) Appl. No.: 15/664,679

(22) Filed: Jul. 31, 2017

Related U.S. Application Data

(60) Provisional application No. 62/494,181, filed on Aug. 1, 2016.

(51) Int. Cl.
*A47B 9/00* (2006.01)
*A47B 3/06* (2006.01)
*A47B 3/00* (2006.01)

(52) U.S. Cl.
CPC ..... *A47B 3/06* (2013.01); *A47B 3/002* (2013.01)

(58) Field of Classification Search
CPC ..... A47B 43/00
USPC ..... 108/102, 187; 312/262
See application file for complete search history.

(56) References Cited

U.S. PATENT DOCUMENTS

D217,261 S * 4/1970 Gianfagna ..... D6/691.8
3,696,763 A * 10/1972 Evans ..... A47B 47/03 108/157.13
4,713,949 A * 12/1987 Wilcox ..... A47B 45/00 108/102
4,974,526 A * 12/1990 Wiygul, Jr. ..... A47B 3/002 108/157.1
5,664,854 A * 9/1997 Letch ..... A47B 43/00 312/114
6,223,908 B1 * 5/2001 Kurtsman ..... H04Q 1/08 211/175
2012/0304901 A1 * 12/2012 Volin ..... A47B 3/091 108/127

* cited by examiner

*Primary Examiner* — Matthew W Ing
(74) *Attorney, Agent, or Firm* — Mark F. Smith; Smith Brandenburg Ltd

(57) ABSTRACT

A table that can be easily transported and stored and in operation provides a stable surface that can withstand substantial vibration as well as stability when supporting substantial weight or loads that may move along the top of the table or shift in position without the legs buckling or moving out of their supporting position or causing the table to tilt or fall to the side.

11 Claims, 9 Drawing Sheets

PORTABLE TABLE

CROSS-REFERENCE TO PRIOR APPLICATION

This patent application claims benefit to U.S. Provisional Patent Application Ser. No. 62/494,181 filed Aug. 1, 2016 titled Portable Table Base With Top and incorporates herein in its entirety herein.

BACKGROUND OF THE INVENTION

Conventional tables typically include a horizontally extending top having legs connected to the top for supporting the top at a height above a surface. Often to make the table more convenient for being transported or for storage, the legs are pivotally connected to the top to allow the legs to be moved such that the extend generally perpendicularly downwardly from the top into a supporting position or moved such that the legs extending longitudinally along the lower surface of the top into a storage position. Other conventional tables include tops that are removably attached to legs such that the top can be moved and stored independently of the legs. Such tables having foldable legs or removable legs are typically designed so that the legs and table top are matched having fixed attachment points such that substituting a different top is often difficult. Further, by using different sized tops with the same attachment points can result in table instability particularly if a substantial load or shifting load is placed on the table top.

Depending on the intended use of a table, in order to add stability to a table, legs are often braced to strengthen the connection of the leg to the table and to prevent the legs from inadvertently moving, such as by pivotally, from a supporting position into a storage position. Tables have also been developed whereby braces are provided that extend between a pair of legs to provide additional support and stability to the table during use. While additional stability could be obtained by using such braces that connect a pair of legs together, such braces only provide a limited amount of stability to the table and often the legs are not easily removed from the top making the table making the table more difficult to transport.

Another problem with conventional tables that are easily transported and stored is that when in use they often do not have the necessary stability for many uses. For example, tables that are used to support work pieces and various machining devices require tables that can withstand substantial vibration as well as shifting of weight. Further tables for supporting substantial weight or loads that may move along the top of the table, must provide support without the legs buckling or moving out of their supporting position.

Accordingly, it would be desirable to have a table that can be easily transported and stored, that can have interchangeable tops, and can provide sufficient stability for a variety of uses.

SUMMARY OF THE INVENTION

The subject invention is a table having a table top with a new and unique support structure that overcomes the problems found in prior art tables. The table is relatively light weight, durable, relatively easy to set up for use and break down for transport and storage and is stable when subjected to relatively heavy static and dynamic or shifting loads.

The subject invention further provides a portable table that reduces the likelihood that the support structure will fail during moving or shifting loads.

In a preferred embodiment of the invention the table comprises a support structure and a planar top having an upper surface and a lower surface removably connected to the support structure. The support structure comprises first and second spaced apart parallel frames each having two elongated legs connected together by an upper strut and a lower strut, and a central frame having an upper rail attached at a first end to the upper strut of the first frame and a second end attached to the upper strut of the second frame and a lower rail attached at a first end to the lower strut of the first frame and a second end attached to the lower strut of the second frame.

In a preferred embodiment of the invention the central frame includes a central joint that operates to permit the central frame to rotate (pivot) into an extended configuration for use in supporting the table top and into a folded configuration for transportation and storage.

In a preferred embodiment of the invention the central frame operates to longitudinally extend or contract for accommodating longitudinally longer or shorter tops, respectively.

In a preferred embodiment of the invention each elongated leg can be longitudinally lengthened or shorten to place the top at a desired position above the ground.

In another preferred embodiment of the invention the top includes top couplings that are attached to the lower surface that mate with corresponding leg couplings positioned at the top ends of each leg for attaching the top to the legs.

In a preferred embodiment of the invention the top couplings are removably attached to the lower surface of the top.

Other advantages, objects, and embodiments of the invention will be apparent from the following description, the accompanying drawings and the appended claims.

BRIEF DESCRIPTION OF THE DRAWINGS

To provide a more complete understanding of the present invention and further features and advantages thereof, reference is now made to the following description taken in conjunction with the accompanying drawings, in which.

DETAILED DESCRIPTION OF THE INVENTION

Figure 1:
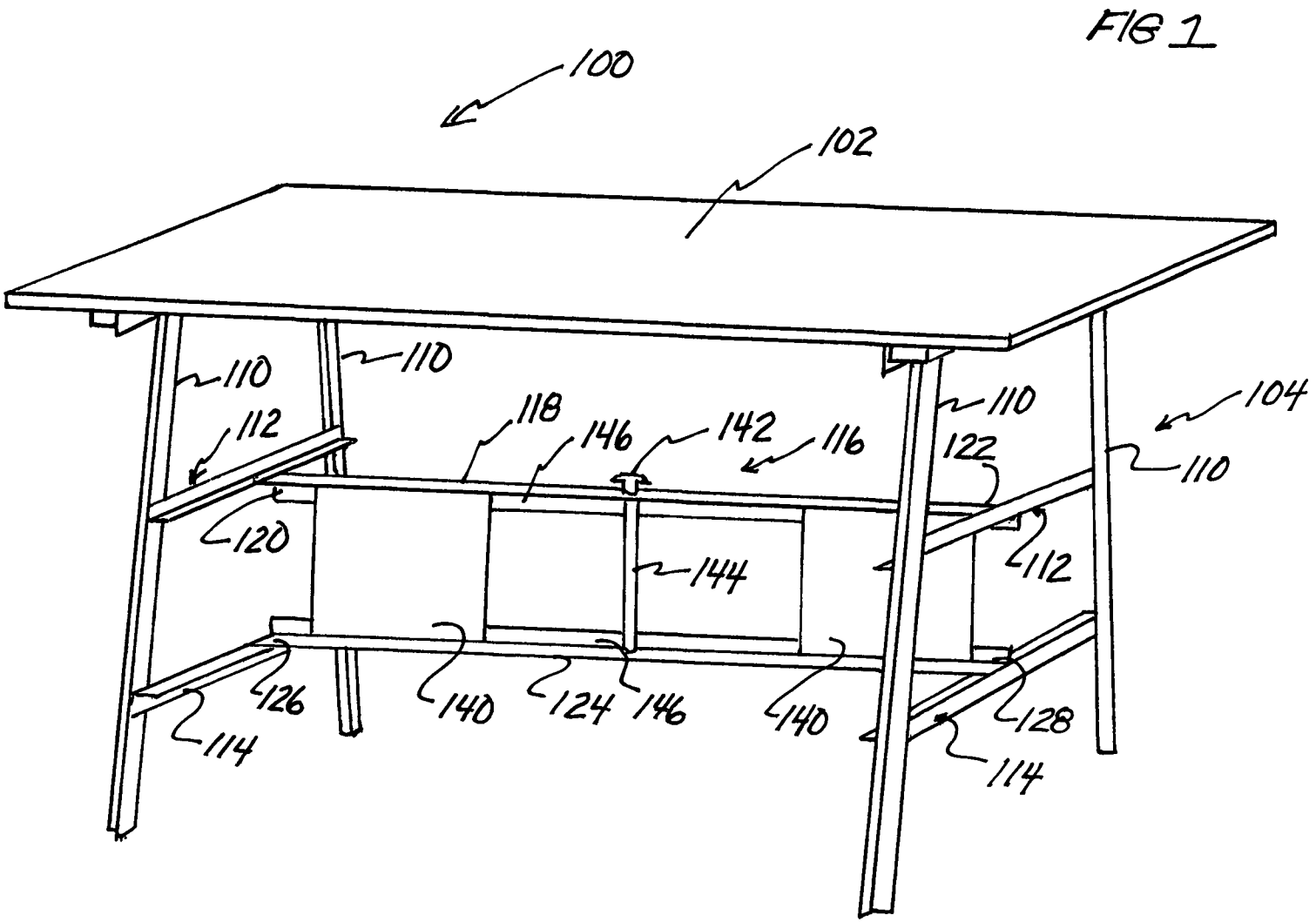
FIG. 1 is a schematic perspective illustration of a preferred embodiment of the table of the subject invention showing a top mounted to a support structure, the support structure having first and second spaced apart parallel frames each with two elongated legs connected together by an upper strut and a lower strut, and a central frame having an upper rail attached at a first end to the upper strut of the first frame and a second end attached to the upper strut of the second frame and a lower rail attached at a first end to the lower strut of the first frame and a second end attached to the lower strut of the second frame.

The subject invention is directed to a table that can be easily transported and stored and in operation provides a stable surface that can withstand substantial vibration as well as stability when supporting substantial weight or loads that may move along the top of the table or shift in position without the legs buckling or moving out of their supporting position or causing the table to tilt or fall to the side. As used herein the terms "downward" or "downwardly" refer to the direction vertically towards the ground or the support surface that the table is resting on. As used herein the terms "upward" or "upwardly" refer to the direction vertically away from the ground or the support surface that the table is resting on. As used herein the term "ground" refers to the ground, floor, or any support surface that the table is resting on. As used herein the term "upper side" refers to the side of an object facing away from the ground. The terms "lower side" refers to the side of an object facing towards the ground. The term "generally perpendicular" refers to the angle of about 67 degrees to 90 degrees. In describing the preferred embodiments of the invention illustrated in the drawings, specific terminology will be resorted to for the sake of clarity. However, the invention is not intended to be limited to the specific terms so selected, and it is to be understood that each specific term includes all technical equivalents that operate in a similar manner to accomplish a similar purpose.

Figure 2:
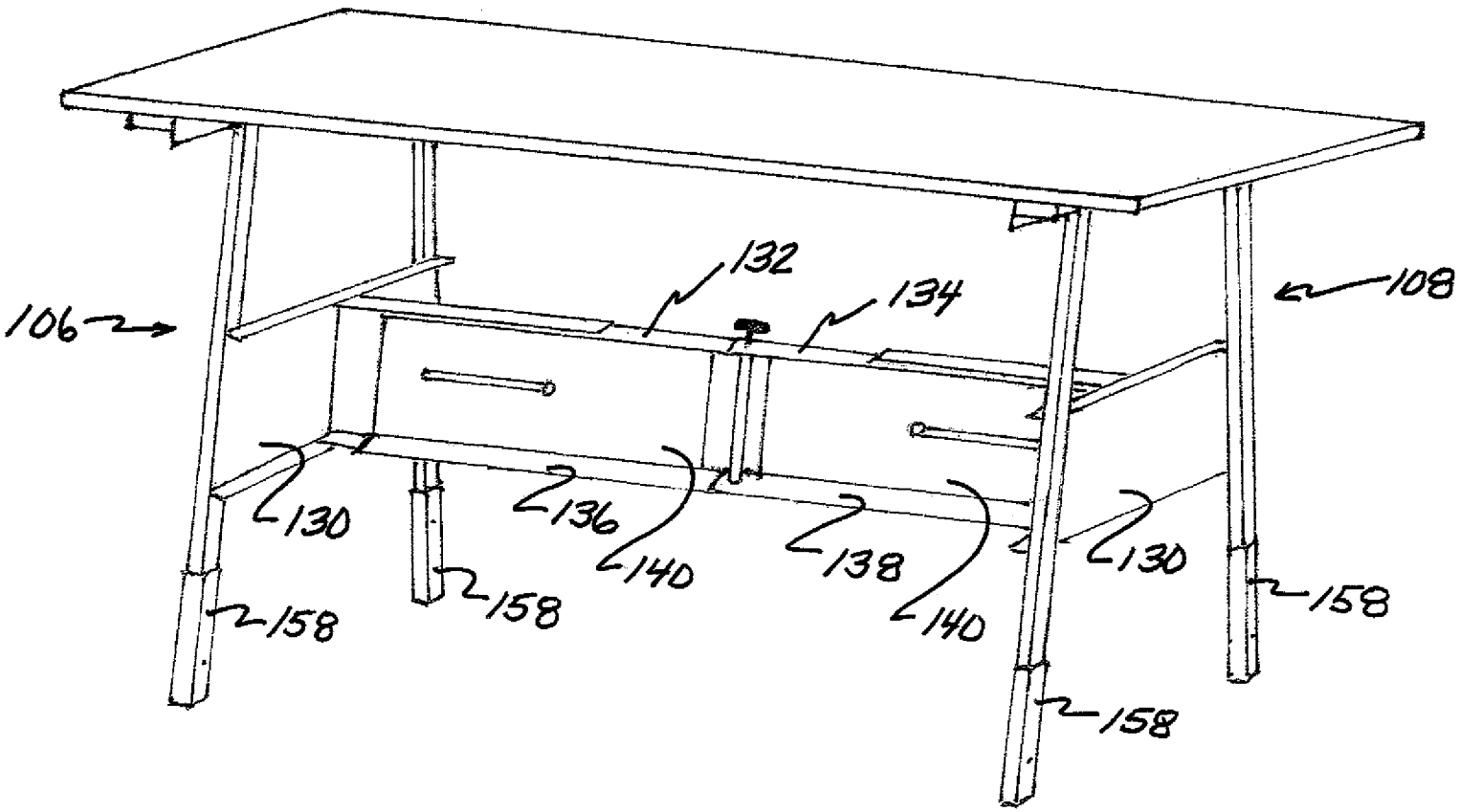
FIG. 2 is a schematic perspective illustration of another preferred embodiment of the table of the subject invention showing the top mounted to the support structure such that the parallel frames include a one or more webs positioned between the upper strut and the lower strut that operate to provide additional rigidity and stability to the support structure and further showing that the central frame is longitudinally adjustable to change the distance between the parallel frames.

Referring to FIGS. 1 and 2, schematic illustrations of the table, generally designated 100, of the subject invention are shown having a planar top 102 mounted to a support structure 104 that operates to support the top 102 at a select distance above the ground G. The support structure 104 includes first and second spaced apart parallel frames, 106 and 108, respectively, each with two elongated legs 110 coupled together by an upper strut 112 and a lower strut 114, and a central frame 116 having an upper rail 118 attached at a first end 120 to the upper strut 112 of the first parallel frame 106 and a second end 122 attached to the upper strut 112 of the second parallel frame 108 and a lower rail 124 attached at a first end 126 of the lower strut 114 of the first parallel frame 106 and a second end 128 attached to the lower strut 114 of the second parallel frame 108.

In a preferred embodiment, as illustrated in FIG. 1, each upper strut 112 and lower strut 114 are in the form of L-shaped horizontal rods extending between the elongated legs 110 of parallel frame 106 and parallel frame 108 and are attached to the legs, such as by welding, bolts, rivets, screws and other like means. It should be understood that the use of the L-shaped horizontal rods reduces the likelihood that the rods will bend or buckle thereby increasing the stability of the parallel frames. In another preferred embodiment of the invention, as shown in FIG. 2, the parallel frames 106 and 108 each include one or more webs 130 positioned between the upper strut 112 and the lower strut 114 that operate to provide additional rigidity and stability to the support structure 104.

Figure 3:
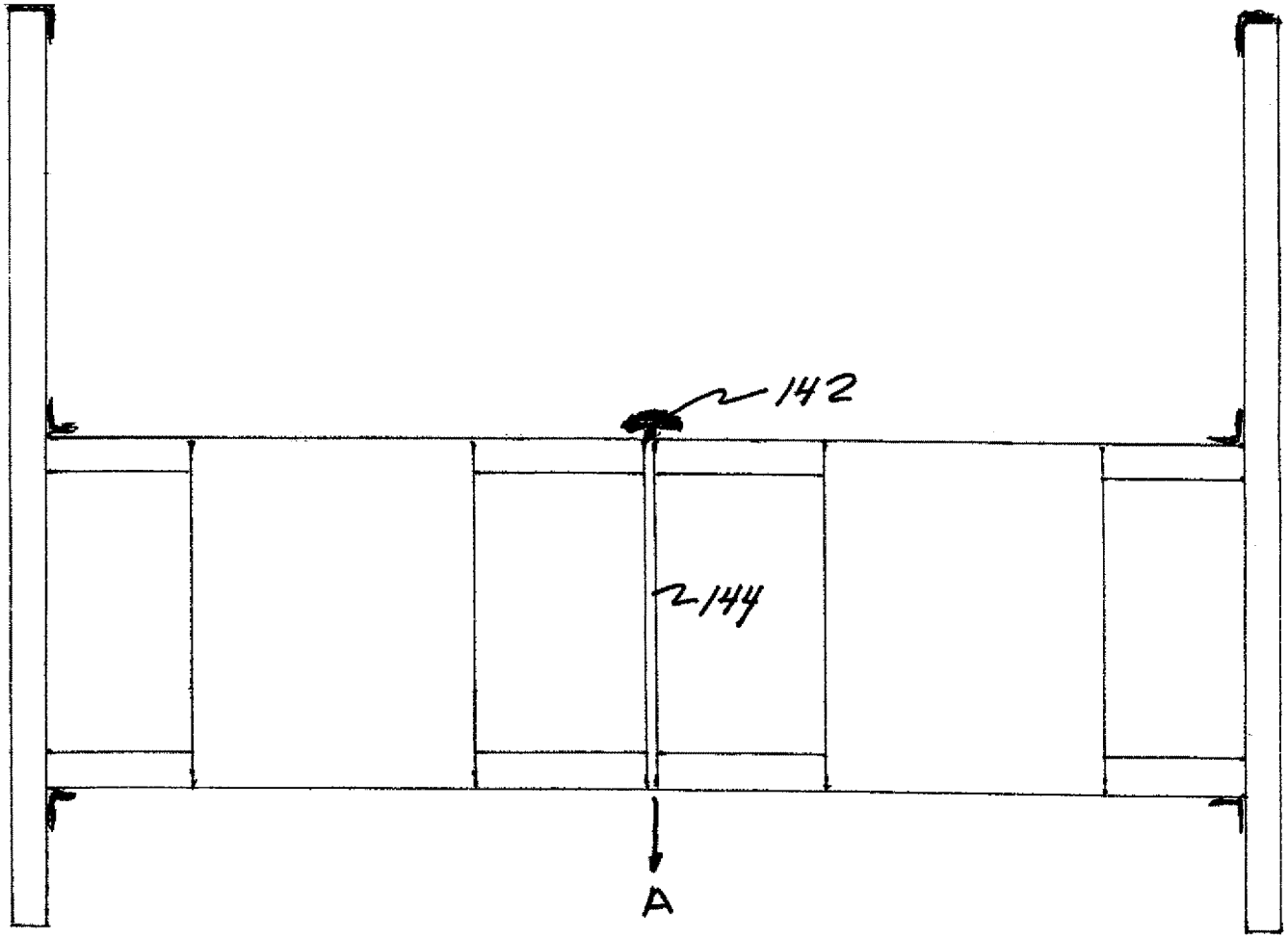
FIG. 3 is a side elevation schematic illustration of the table of FIG. 1 with the top removed and the support structure shown in its fully open configuration.
Figure 4:
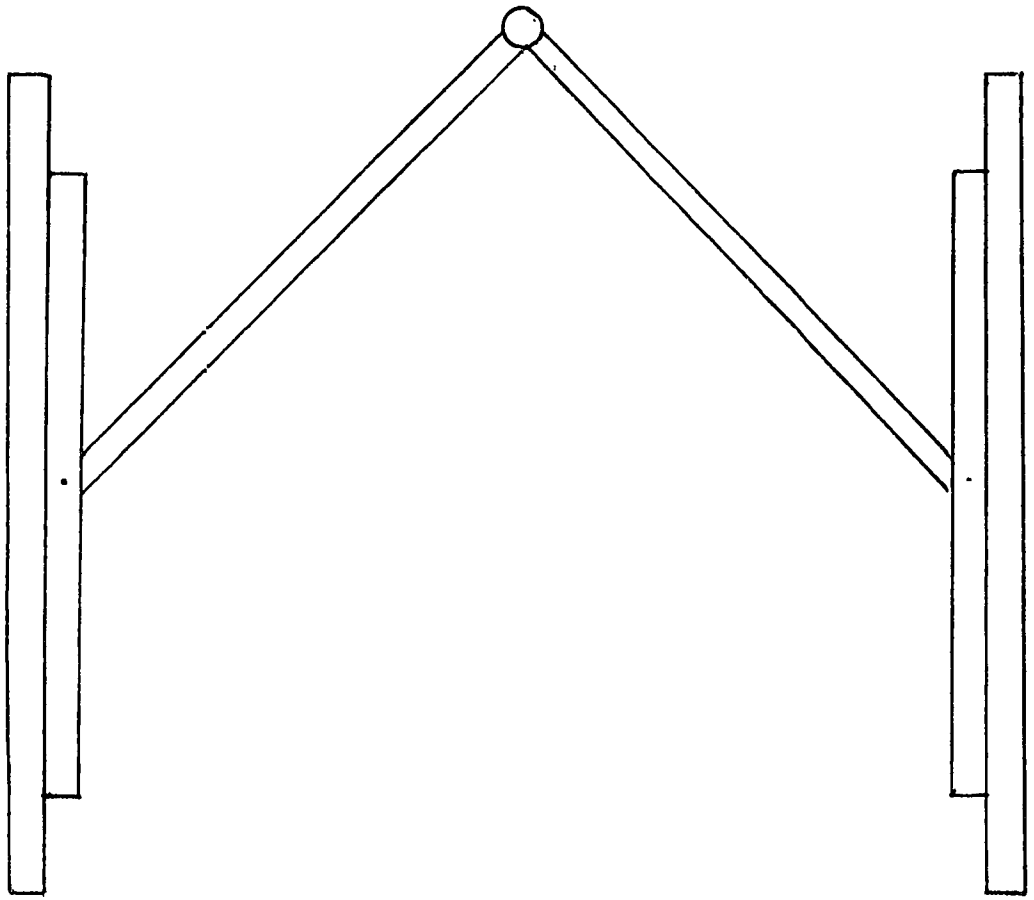
FIG. 4 is a side elevation schematic illustration of the table of FIG. 1 with the top removed and the support structure shown in its partially folded configuration.
Figure 5:
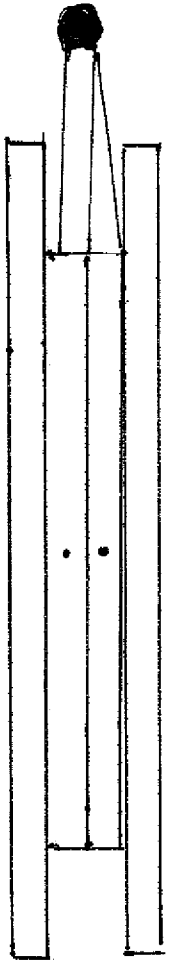
FIG. 5 is a side elevation schematic illustration of the table of FIG. 1 with the top removed and the support structure shown in its fully folded configuration.

Referring to FIGS. 3, 4 and 5, a preferred embodiment of the invention is shown whereby the central frame 116 of the support structure 104 is shown such that the upper rail 118 is pivotally attached at the first end 120 to the upper strut 112 of the first parallel frame 106 and the second end 122 is pivotally attached to the upper strut 112 of the second parallel frame 108 and the lower rail 124 is pivotally attached at the first end 126 of the lower strut 114 of the first parallel frame 106 and the second end 128 is pivotally attached to the lower strut 114 of the second parallel frame 108. The upper rail 118 is formed from a first upper rail component 132 and a second upper rail component 134 and the lower rail 124 is formed from a first lower rail component 136 and a second lower rail component 138. In a preferred embodiment of the invention, positioned between the upper rail 118 and the lower rail 124 is one or more webs 140 that operate to provide increased strength and stability to the central frame 116 and the support structure 104 in general. The first upper rail component 132 and the second upper rail component 134 are pivotally attached together and the first lower rail component 136 and the second lower rail component 138 are pivotally connected together, such as by a screw, hinge or other suitable pivoting device that operates to permit the rails to pivot (rotate). In a preferred embodiment a tightener 142 is provided, such as in the form of an elongated screw, that joins together the first upper rail component 132 and the second upper rail component 134 and the first lower rail component 136 and the second lower rail component 138, thereby forming a central joint 144, that operates to pivot along the longitudinal axis A of the tightener 142 when the tightener 142 is not tight and prevents pivoting and held in a fixed position when the tightner 142 is tightened. It should be understood that the tightner can be in various forms such as a clamp or other similar device that operate to permit the rail components to rotate and pivot into or from a fully open configuration (FIG. 3) or into and from a partially open configuration (FIG. 4) or a fully closed configuration (FIG. 5) for transporting and/or storage. In a preferred embodiment the tightener further operates to lock the rail components into a desired configuration such that they are prevented from pivoting and can be easily transported.

Figure 8:
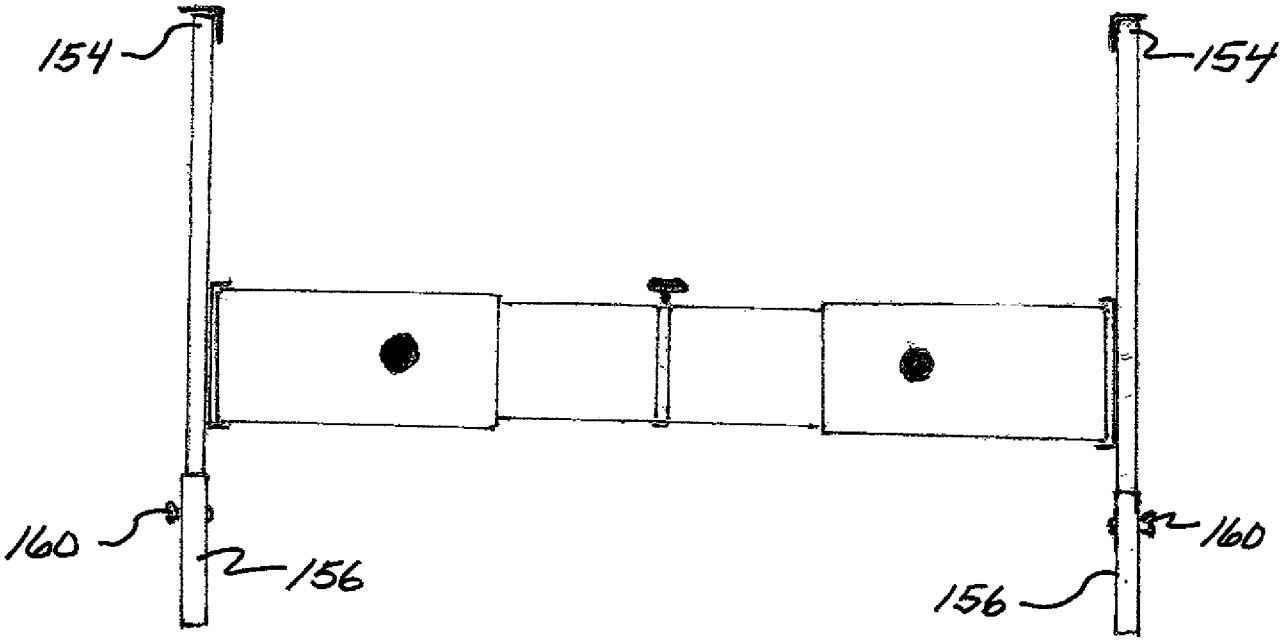
FIG. 8 is a schematic side elevation illustration of another preferred embodiment of the invention showing the central frame formed having slidable plates that operate together to longitudinally change the distance between the parallel frames.

Referring to FIGS. 2, and 8, the central frame 116 of the support structure 104 is longitudinally adjustable to move the first and second spaced apart parallel frames, 106 and 108 respectively, closer together or farther apart to accommodate different tops 102. For example, to accommodate a longitudinally longer top the first and second spaced apart parallel frames can be moved farther apart and to accommodate a longitudinally shorter top the first and second spaced apart parallel frames can be moved closer together.

Figure 6:
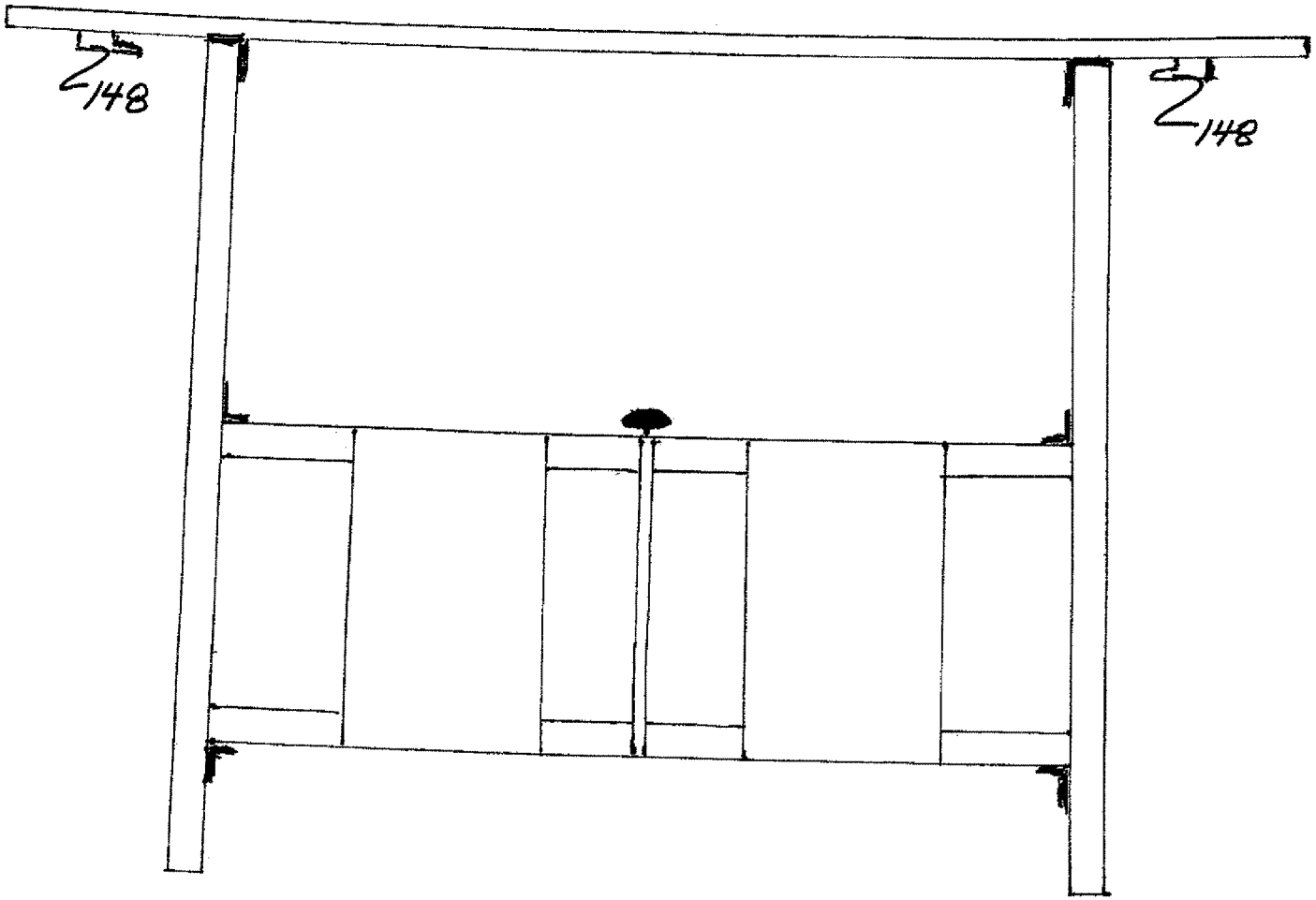
FIG. 6 is a schematic side elevation illustration of the table of FIG. 2 showing the top resting on the support structure with the sliding clamps attached to the lower surface of the top aligned with, but not mated with, corresponding clamps positioned at the top ends of each leg for removably attaching the top to the legs.
Figure 7:
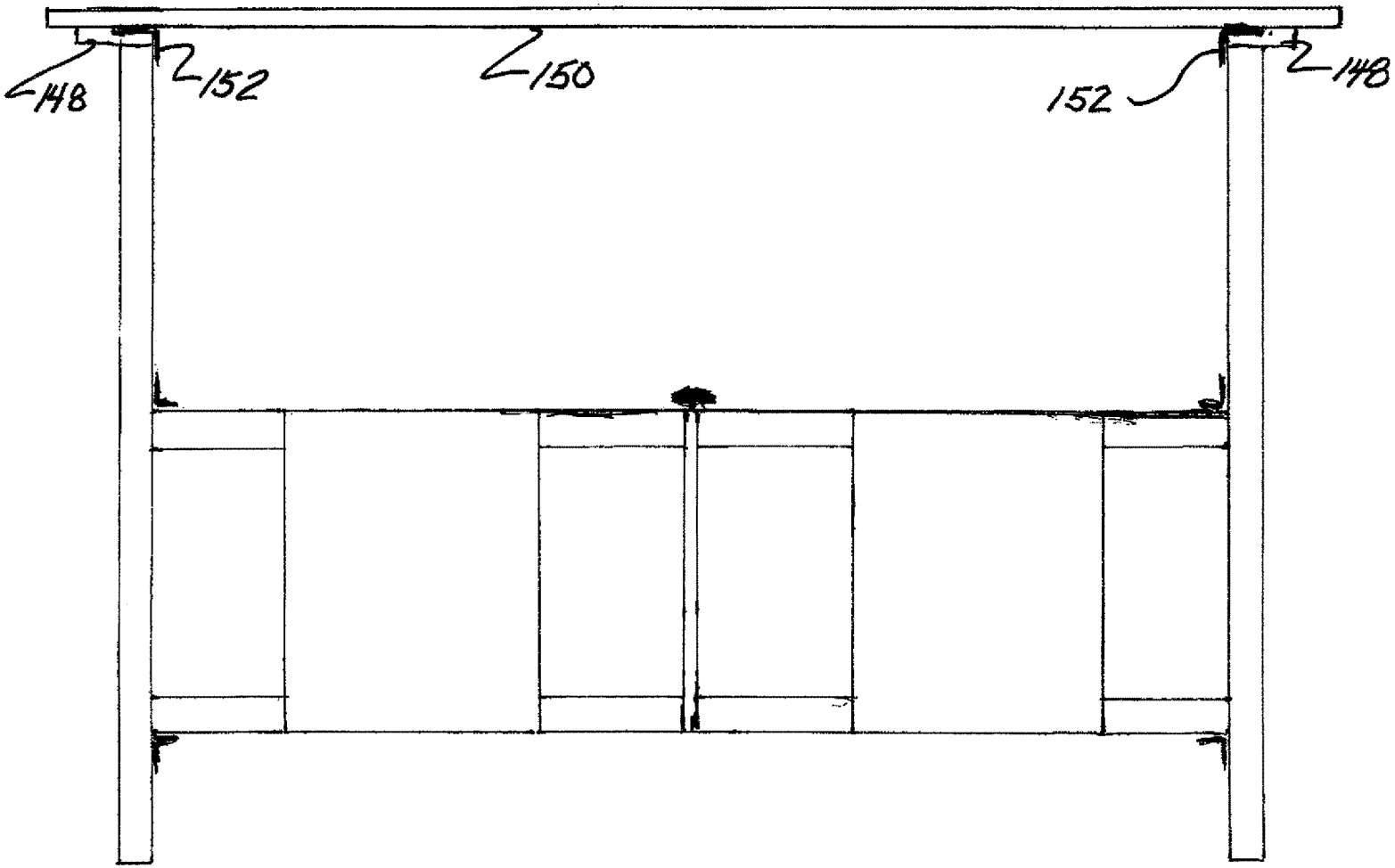
FIG. 7 is a schematic side elevation illustration of the table of FIG. 2 showing the top resting on the support structure with the sliding clamps attached to the lower surface of the top aligned and mated with corresponding clamps positioned at the top ends of each leg for removably attaching the top to the legs.
Figure 9:
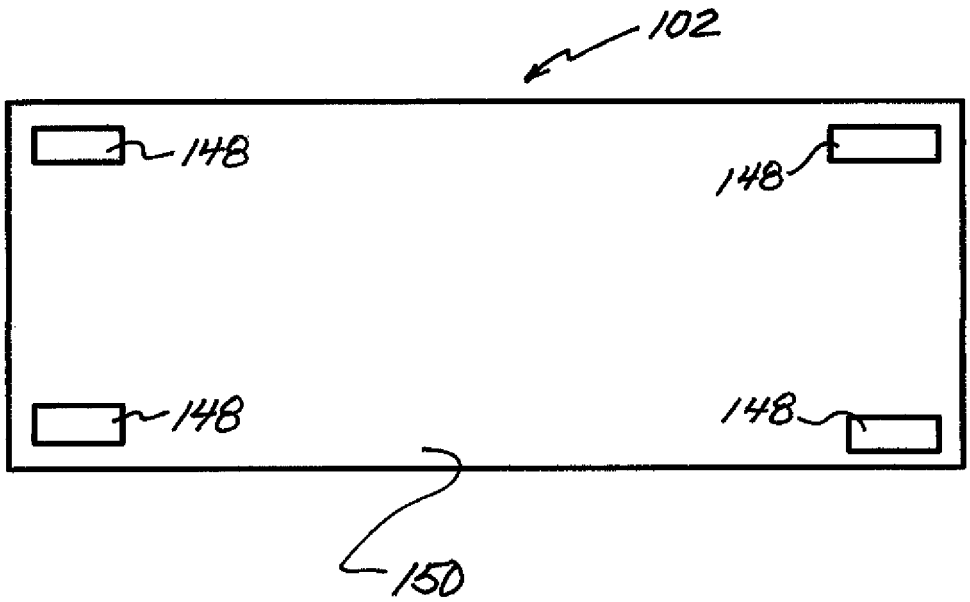
FIG. 9 is a schematic planar illustration of the lower surface of the top having top couplings that mate with corresponding leg couplings positioned at the top ends of each leg of the support structure.

It should now be apparent that by moving the spaced apart parallel frames to accommodate the length of the top allows different tops to be utilized using a common support structure while maintaining the stability of the table. As illustrated in FIG. 2, in another preferred embodiment of the invention the upper rail 118 is formed from a first upper rail component 132 and a second upper rail component 134 and the lower rail 124 is formed from a first lower rail component 136 and a second lower rail component 138. As shown, the first upper rail component 132, second upper rail component 134, first lower rail component 136 and second lower rail component 138 each ride along respective longitudinally extending tracks or guide rails 146 that operate to guide the rail components and permit them to slide longitudinally inwardly away from the spaced apart parallel frames or outwardly towards the spaced apart parallel frames. In this way the spaced apart parallel frames 106, 108 can slide inwardly, towards each other, such as shown in FIG. 6, to disconnect the top 102 from the support structure 104 or slide outwardly, away from each other, as shown in FIG. 7, to connect the top 102 to the support structure 104. It should now be apparent that the amount that the spaced apart parallel frames 106, 108 are moved inwardly or outwardly depends on the longitudinal length or the top 102 and the location of the top couplings 148 that are attached to the lower surface 150 of the top 102 that mate with corresponding leg couplings 152 positioned at the top ends 154 of each leg 110 for removably attaching the top 104 to the legs 110 (FIG. 9). It should be apparent that, as shown in FIG. 2, the one or more webs 140 that are placed between the upper rail 118 and the lower rail 124 of the central frame 116 operate to provide additional support and stability to the central frame 116 and the support structure 104.

As illustrated in FIGS. 6, 7 and 9, the lower surface 150 of top 102 top couplings 148 that are attached to the lower surface 150 of the top 102, fixed such as by nails, glue and the like, or removably, such as by screws, Velcro, and the like. In operation, the top couplings 148 operate to mate with corresponding leg couplings 152 positioned at the top ends 154 of each leg 110 by sliding the spaced apart parallel frames 106, 108 closer until the top couplings 148 are fully nested within the corresponding leg couplings 152 thereby removably attaching the top 104 to the legs 110. Once the couplings are in their proper nested position, the central frame 116 is locked into position, by tightening the tightner 142 which operates to maintain the couplings in their mated position. It should be understood that the top couplings 148 can be installed on a variety of sized tops 102 such that the size of the table top can be easily increased or decreased by simply attaching the top couplings 148 in the desired location (preferably at the longitudinally ends of the top, on the lower surface 150 of the top 102.

In another preferred embodiment, as illustrated in FIGS. 2 and 8, the legs 110 each include a slidable rod 156 telescoping positioned about the lower portion of leg 110 and preferably includes a plurality of holes 158 longitudinally positioned along the rod 156 that cooperate with a height adjustment mechanism 160, such as a tightening screw, positioned within one of the plurality of holes 158 such that when tightened it travels through the desired hole 158 and frictionally locks the leg 110 and the slidable rod 156 in position. The height adjustment mechanism 160 operates such that when released, such as by unscrewing the screw such that it no longer is pressed against the leg 110 the slidable rod 156, it is free to move upwardly along the leg 110 thereby longitudinally shortening the leg 110 or move downwardly along the leg 110 thereby longitudinal lengthening the leg 110. It should be understood that other conventional height adjustment mechanisms can be used that operate to allow the slideable rod to freely move longitudinally upwardly and downwardly along the leg and that to lock the slidable rod into a desired longitudinal position along the leg to place and maintain the table top at a desirable height above the ground.

It should now be apparent that the subject invention is a table that can be easily transported and stored and in operation provides a stable surface that can withstand substantial vibration as well as stability when supporting substantial weight or loads that may move along the top of the table or shift in position without the legs buckling or moving out of their supporting position or causing the table to tilt or fall to the side. The use of a unified support structure comprising first and second spaced apart parallel frames connected together by a central frame operates together to synergistically create a substantially stable structure that reduces the likelihood that the individual support structure components will yield, buckle, or collapse by substantial weight shifting on the top of the table. Further, the use of top couplings that can be placed at the corners of the lower surface of the top and the use of an adjustable support structure that permits the tops of the legs to mate with the top couplings places the support structure, and the legs, and the optimal position for table stability. Further, it should now be apparent that the table of the subject invention can be easily transported and stored, has a support structure that can be varied to receive different sizes of interchangeable tops, and can provide sufficient stability for a variety of uses.

The invention claimed is:

1. A table comprising:

a support structure;

a planar top having an upper surface and a lower surface removably connected to said support structure;

wherein said support structure having a first and a second spaced apart parallel frames each having two elongated legs with a top end and a lower portion and connected together by an upper strut and a lower strut positioned between said top ends and lower portions of said elongated legs such that the distance between said legs increases in a downward direction, and a central frame having an upper rail pivotally attached at a first end to said upper strut of said first frame and a second end pivotally attached to said upper strut of said second frame and a lower rail pivotally attached at a first end to said lower strut of said first frame and a second end pivotally attached to said lower strut of said second frame, wherein said upper rail of said central frame and said lower rail of said central frame are coupled together by a vertically extending central joint equally spaced between all of said elongated legs.

2. The table of claim 1 wherein said central joint operates to permit said central frame to rotate said first frame and said second frame such that said first frame and said second frame move away from each other into an extended configuration and to move towards each other and into a folded configuration.

3. The table of claim 1 wherein said central frame operates to longitudinally extend or contract to attach longer or shorter tops, respectively.

4. The table of claim 1 wherein each said elongated leg operates such that it can be lengthened or shorten to place said top at a desired position above the ground.

5. The table of claim 1 wherein said top includes top couplings that are attached to the lower surface of said top and mate with corresponding leg couplings positioned at the top ends of each said leg and cooperate together to attach said top to said legs.

6. The table of claim 1 wherein said upper strut and said lower strut are in the form of L-shaped horizontal rods.

7. The table of claim 1 wherein said first spaced apart parallel frame includes one or more webs positioned between said upper strut and said lower strut of said first spaced apart parallel frame and wherein said second spaced apart parallel frame includes one or more webs positioned between said upper strut and said lower strut of said second spaced apart parallel frame.

8. The table of claim 1 wherein said central frame includes one or more webs positioned between said upper rail and said lower rail.

9. A table comprising:

a support structure;

a planar top having an upper surface and a lower surface removably connected to said support structure;

wherein said support structure having a first and a second spaced apart parallel frames each having two elongated legs with a top end and a lower portion and wherein said legs are connected together by an upper strut and a lower strut positioned between said top end and said lower portion of each said leg, and a central frame having an upper rail pivotally attached at a first end to said upper strut of said first frame and a second end pivotally attached to said upper strut of said second frame and a lower rail pivotally attached at a first end to said lower strut of said first frame and a second end pivotally attached to said lower strut of said second frame, wherein said central frame further comprising a vertically extending central joint equally spaced between all of said elongated legs and wherein said upper rail of said central frame and said lower rail of said central frame are coupled together by said vertically extending central joint and operates to permit said central frame to rotate into an extended configuration and into a folded configuration;

wherein said upper strut and said lower strut are in the form of L-shaped horizontal rods;

wherein said upper rail and said lower rail operate to slide longitudinally inwardly and outwardly to move said spaced apart parallel frames towards or away from each other;

wherein each said elongated leg operates to lengthened or shorten to place said top at a desired position above the ground; and wherein said top includes removable top couplings that are attached to said lower surface of said top and mate with corresponding leg couplings positioned at said top ends of each said leg and cooperate together to removably attach said top to said legs.

10. The table of claim 9 wherein said first spaced apart parallel frame includes one or more webs positioned between said upper strut and said lower strut of said first spaced apart parallel frame and wherein said second spaced apart parallel frame includes one or more webs positioned between said upper strut and said lower strut of said second spaced apart parallel frame.

11. The table of claim 9 wherein said central frame includes one or more webs positioned between said upper rail and said lower rail.

* * * * *